US009283459B2

(12) United States Patent
Adema

(10) Patent No.: US 9,283,459 B2
(45) Date of Patent: Mar. 15, 2016

(54) SOCCER TRAINING DEVICE, METHOD OF USE AND SYSTEM

(71) Applicant: Wayne P. Adema, Sheboygan Falls, WI (US)

(72) Inventor: Wayne P. Adema, Sheboygan Falls, WI (US)

(73) Assignee: PROCONTROL, INC., Sheboygan, WI (US)

( * ) Notice: Subject to any disclaimer, the term of this patent is extended or adjusted under 35 U.S.C. 154(b) by 51 days.

(21) Appl. No.: 13/804,422

(22) Filed: Mar. 14, 2013

(65) Prior Publication Data

US 2013/0344996 A1 Dec. 26, 2013

Related U.S. Application Data

(63) Continuation-in-part of application No. 13/587,715, filed on Aug. 16, 2012.

(60) Provisional application No. 61/662,551, filed on Jun. 21, 2012.

(51) Int. Cl.

*A63B 69/00* (2006.01)
*A63B 67/00* (2006.01)
*A63B 63/00* (2006.01)
(Continued)

(52) U.S. Cl.

CPC ..... *A63B 69/0097* (2013.01); *A63B 69/002* (2013.01); *A63B 63/00* (2013.01); *A63B 63/004* (2013.01); *A63B 2071/024* (2013.01);
(Continued)

(58) Field of Classification Search

CPC ..... A63B 69/0097; A63B 63/00; A63B 2225/09; A63B 69/002; A63B 2243/0025
USPC ..... 473/422, 434, 435, 446, 454, 470, 478
See application file for complete search history.

(56) References Cited

U.S. PATENT DOCUMENTS 4,258,924 A * 3/1981 Ketchum ..... 473/435
4,284,277 A 8/1981 Leonard et al.
(Continued)

FOREIGN PATENT DOCUMENTS

WO WO 0124891 A1 * 4/2001 ..... A63B 69/00
WO WO 2008102210 A3 * 4/2009 ..... A63B 67/00

OTHER PUBLICATIONS

YouTube Video, https://www.youtube.com/watch?v=av5b8tyK3Ao.
(Continued)

*Primary Examiner* — Mitra Aryanpour
(74) *Attorney, Agent, or Firm* — Boyle Fredrickson, S.C.

(57) ABSTRACT

The invention provided is directed to a soccer training device, module training system and method of use. The device is a deflection wall that may be portable or permanently affixed to a ground surface. The wall having a larger and smaller embodiment, mimicking the silhouette of a soccer goal or an average player of a given age range from a far distance at simulated closer range. The inventive features of the wall intended to enhance quantity, quality, speed, and accuracy of interaction and perception between the user, the ball and the wall according to professional quality and professional level training techniques. Multiple wall units may be combined to create individualized training modules wherein one person may train in a simulated multiplayer environment of varying levels of complexity. Two or more module units may be combined to create a soccer training system. The modules and systems may be staged in limited ground surface area both indoor and outdoor.

9 Claims, 14 Drawing Sheets

(51) Int. Cl.
*A63B 71/02* (2006.01)
*A63B 71/06* (2006.01)

(52) U.S. Cl.
CPC ..... *A63B2071/0694* (2013.01); *A63B 2210/50* (2013.01); *A63B 2243/0025* (2013.01)

(56) References Cited

U.S. PATENT DOCUMENTS 4,650,189 A 3/1987 Rajacich
5,524,900 A * 6/1996 Allen ..... 273/396
5,556,104 A 9/1996 Guillen, Jr.
5,863,266 A * 1/1999 Starnes ..... 473/471
5,961,403 A * 10/1999 Caruso ..... 473/446
6,068,488 A * 5/2000 Sinsheimer et al. ..... 434/251
6,200,234 B1 * 3/2001 Hannon ..... 473/471
6,264,572 B1 * 7/2001 Matheson et al. ..... 473/446
6,312,348 B1 * 11/2001 Sandell ..... 473/415
6,846,253 B1 * 1/2005 Szwalek ..... 473/446
6,935,971 B2 8/2005 Piras et al.
6,966,852 B2 * 11/2005 Yoon ..... 473/421
7,001,288 B2 * 2/2006 Harrell ..... 473/446
7,909,330 B2 3/2011 Domjen
8,079,923 B2 * 12/2011 Siefker ..... 473/446
D652,462 S * 1/2012 Sun ..... D21/706
8,480,517 B2 * 7/2013 Guttler ..... 473/446
D689,570 S * 9/2013 Adema ..... D21/698
D695,908 S * 12/2013 Adema ..... D25/1
8,647,221 B1 * 2/2014 Hochberg ..... 473/446
D702,365 S * 4/2014 Adema ..... D25/12
D704,285 S * 5/2014 Zucca et al. ..... D21/699
D712,494 S * 9/2014 Adema ..... D21/706
2001/0034274 A1 * 10/2001 Tulipani et al. ..... 473/446
2002/0002540 A1 1/2002 DeMello et al.
2002/0022540 A1 * 2/2002 Slomski et al. ..... 473/478
2004/0038189 A1 * 2/2004 Wilgenburg et al. ..... 434/251
2004/0132558 A1 * 7/2004 Rothman ..... 473/434
2004/0235589 A1 * 11/2004 Wedgbury ..... 473/446
2005/0012125 A1 1/2005 Summerfelt et al.
2005/0192125 A1 9/2005 Valliquette
2006/0089213 A1 * 4/2006 Snyder ..... 473/435
2006/0237913 A1 * 10/2006 Giske et al. ..... 473/470
2008/0032826 A1 * 2/2008 Mubarak et al. ..... 473/446
2009/0069125 A1 * 3/2009 Porter ..... 473/435
2009/0139157 A1 6/2009 Jones
2012/0329584 A1 * 12/2012 Pinezich et al. ..... 473/446
2013/0344996 A1 * 12/2013 Adema ..... 473/422
2013/0344998 A1 * 12/2013 Adema ..... 473/435
2014/0024481 A1 * 1/2014 Adema ..... 473/446

OTHER PUBLICATIONS

YouTube Video, https://www.youtube.com/watch?v=SyoJvJCgUJc.

* cited by examiner

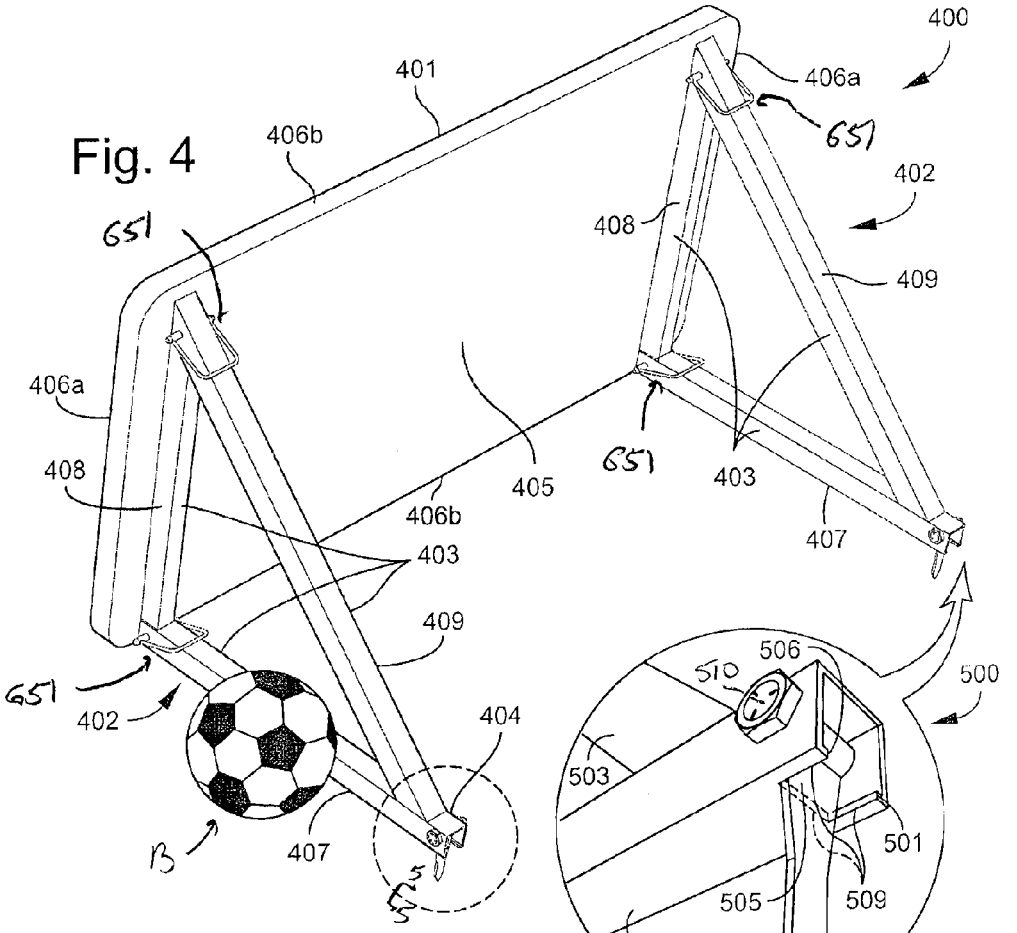
Fig. 4
Fig. 5A
Fig. 5B
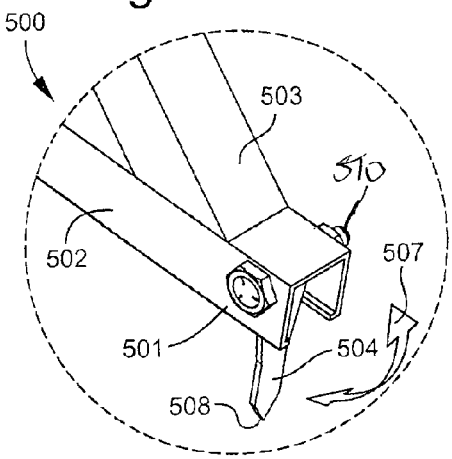
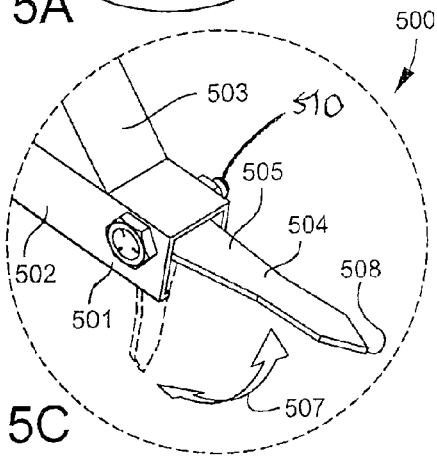
Fig. 5C

SOCCER TRAINING DEVICE, METHOD OF USE AND SYSTEM

CROSS REFERENCE TO RELATED APPLICATIONS

This non-provisional patent application is a continuation-in-part of U.S. Non-Provisional patent application Ser. No. 13/587,715, filed on Aug. 16, 2012, which in turn claims priority from U.S. Provisional Patent Application Ser. No. 61/662,551, filed on Jun. 21, 2012, pursuant to 35 U.S.C. 119(e) and 37 C.F.R. 1.78 (a)(4)-(a)(6) and all other relevant sections of the law not referred to herein, each of which are expressly incorporated by reference herein in their entirety.

STATEMENT REGARDING FEDERALLY SPONSORED RESEARCH OR DEVELOPMENT

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

1. Field of the Invention

The present inventive subject matter relates to a soccer training device, a soccer training system and a method of use.

2. Background

Mastering the game of soccer requires the mastery of one's own body and eye coordination. It is a contact sport where a player's entire body must be intuitively responsive to the ball on the field at any particular time or location. The player's muscles must react reflexively to the field and all things within as though they are extensions of his own body. Professional soccer players spend tremendous amounts of time conditioning their bodies to achieve a level of muscle memory and intuition that makes their movement on the field second nature and fluid. While actual practice is the only way a player can improve his or her skill, the quality and amount of practice determines the rate of actual improvement. In order for any individual to propel themselves to the next level of skill in the game of soccer, they must dedicate sufficient time on the field and off the field to constant muscle training. Soccer being a high contact sport requires equipment and training techniques that simulate a multi-player environment that provides constant dynamic contact.

Mastery of the game requires repetitive training to develop speed and control over the ball and the player's ever changing environment. Improvement of skill requires exposure to new complex variables and the opportunity to practice controlling and overcoming such variables. Variables in the game may be any element in the environment that changes the position of the ball, the player or the team's advantage. Variables may become more complex as more players are involved in a particular game. They may still be complex between fewer players if the skill level of each player enables them to each possess greater control over the ball. It is the aspiration of any soccer player to develop advanced level of skill such that the individual can act and strategize offensively or defensively to capture and maintain control over the ball in any fast paced scenario. To achieve this beyond a team training effort, through individual training, a player must be able to simulate realistic multi-player conditions to create the types of variable challenges encountered on the field during a fast paced game. For a player to develop his or her skills at professional quality level, the player must train and hone his or her skills to the true parameters of the game. High amounts of repetitious training in a simulated dynamic environment will enable any individual player to develop professional level precision, speed and agility that can be translated onto the field in any live match.

The ideal training device and system should be true to the parameters and dimensions of the game. Such parameters include but are not limited to the following: spatial limitations, area of control over the ball within the player's environment, high paced interaction between multiple players, dynamic changing environment from high speed movement of players on the field, intense competition between players to control the soccer ball, spatial spread of players on a field in the course of a game, necessary levels of accuracy in aim for passing and shooting the ball, standard positioning of soccer field components such as the goal posts or other players, quality and types of interaction between the player and different elements on the field (spinning the ball, passing the ball between players, etc.), material composition of equipment (rubber soles of shoes and the ball), visual effects from the field environment and components within (white or metallic soccer goals, green sod for outdoor soccer field, tan wooded floors of indoor soccer arena), etc. The ideal training device and system would manage and control the scope of variables so that the user can recreate and repeat training, or scale the variables down to focus on specific sets of variables. The device and system would evolve with the user by enabling the user to introduce new challenges or variables at various stages of improvement. All the while, such a device should remain useful and relevant to users of all skill levels. The ideal device should enable an individual user to achieve high amounts of repetitious contact with the ball, achieve high speed multidirectional movement and tight ball control, train to the true parameters of the game, and develop multiple skills in tandem as would be expected from a multi-player training environment.

Current products in the market that offer individualized repetitive training fail to reflect real parameters and challenges experienced on the field specific to the sport of soccer. These products are easily outgrown due to their limited usefulness relative to the long term needs of aspiring soccer players. The following summarizes current soccer rebound devices designed primarily for kick training. Their deficiencies and limitations are inherent in their designs, offering limited practical use to serious trainers. U.S. Pat. No. 5,556,104 provides a training device with multiple functions on multiple sides. The problem is that each functional side interferes with the usefulness of the other feature during training. Further, the device is not constructed in a manner that when positioned on the ground with the board surface side facing forward, would maintain stability against frequent high impact contact with a soccer ball.

U.S. Pat. No. 4,650,189 is a rebound net assembly intended for softball or baseball pitch training. Not only are there too many parts to this device making it difficult to transport, but the net feature is not ideal for soccer training purposes since it cannot replicate a deflection similar in feel and quality to that of a professional soccer player. Further, the surrounding frame protrudes from the overall wall surface, creating interaction with the ball that is not otherwise experienced in reality. The device also lacks a self-stabilizing component that allows it to withstand the full impact of repeated impact of a high speed soccer ball.

U.S. Patent Application No. 2005012125A1 provides a device with multiple paneled sides that requires assembly to be functional. The design of this device prevents it from being staked or anchored to the ground for added stability. The weight of water or sand filling its cavity is insufficient to stabilize the device against frequent high impact of a soccer ball by serious trainers. Further, the size and shape of the device does not reflect the natural coverage of an opposing player's silhouette. Thus accuracy and precision of the player would be disproportionately skewed to the disproportionate size of the device over time and use.

The device of U.S. Patent Application No. 20020022540 A1 takes up a great amount of space on the field with its multi-panel construction. This device is very one dimensional in that, despite the multi-panels involved and the ability to have multiple users train at once, players are restricted to using one panel at a time and cannot train interactively with other players.

U.S. Pat. No. 7,909,330 comprises a hollow base requiring filler, such as water or sand, to create stabilizing weight. As stated before, the design is inconvenient and unstable for the quality and amount of ball to wall impact sought to be achieved by serious trainers.

U.S. Pat. No. 6,935,971 provides another rebound panel made of netting. A great deal of assembly is required and the device is not easily transportable. As with other netted devices, the frame surrounding the four sides of the device interferes with the ball's trajectory path and the interaction of the ball with the rebound surface.

U.S. Pat. No. 4,284,277 describes a kick ball game and apparatus kit that may be used indoor or outdoor, played similarly to soccer or hockey but does not require special skills from the players. This patent provides for an interesting method of arranging players of the game with predefined rules of operation. This patent is not intended as a soccer training method or apparatus and does not function as such.

A considerable need remains for inventive solutions that improve upon the quality of soccer training devices, methods and systems. All patents and applications referred herein are incorporated by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

SUMMARY OF THE INVENTION

The invention herein achieves a quality and type of professional grade training never seen before for individualized soccer training. The award winning professional level skill and experience of the inventor as both a lifetime soccer athlete and coach has enabled the inventor to gain the proper insight to develop a device and system that offers these combined training features in an elegant and effective way. The goal of this invention is to enable an individual user to achieve high amounts of repetitious foot training, practice high speed multi-directional movement while maintaining tight control over a soccer ball, develop accurate aim, perception and intuition for the true parameters of the game, and eventually learn to strategize and control both the ball and the player's unpredictable environment. These goals are achieved by the unique design and training method described as follows.

The invention herein makes optimal use of material and design by improving on the following features: choice of material composition of the device to enhance realistic simulated interaction between the ball and user, effective use of exposed surfaces on the device to maximize interaction, ergonomic design to avoid unwanted secondary interactions (e.g., no protruding attachments from the wall such as nuts and bolts to avoid unnatural deflection of the ball from the wall, no extra framing, etc.), dimensional considerations so as to simulate true distance and size parameters between the players on a field, compressed dimensional features to encourage high speed proximate interaction, choice of color to condition the user's depth and peripheral perception, minimization of secondary distractions not natural to the game (such as loose rattling or reverberation), simulation of multi-player environment by modularizing the device which encourages high speed multidirectional interaction and control, consideration of distance between devices within a given module specifically to train passing techniques according to best practice for professional quality soccer training, adjustability of modules to control complexity and allow for personalized training.

The device described herein is a soccer deflection wall. Each device or wall is comprised of one or more panels and a supporting unit or anchor support assembly. Each said panel may be embodied in the shape of either a square or rectangle but is not limited to these described shape embodiments. The panels having rounded exposed corners to minimize wear and tear on a deflecting ball and to mimic the interaction of a ball against the curve of a player's foot. The word exposed hereinafter will mean any surface that is open and unobstructed from the general field environment such that said surface may have direct contact with a traversing ball approaching or deflecting from said surface. All exposed surfaces of the device that may serve to deflect the soccer ball should be completely even without protrusion, introverted contours, recesses, cracks or crevices, holes, extensions, etc. Protrusions from exposed surfaces such as bolts and frame attachments or crevices and cavities could cause unnatural deflection of the ball and risk expensive damage to the impacting ball. The dimension of the wall (vertical length and horizontal width) should simulate the proportional perspective of a far distant silhouette of a player of a given age range or goal post from close proximity. The device may be scaled up or down to the relative size of the user to achieve the intended purpose. For example, infant children approximately three years of age may require smaller versions of the device to achieve the same goals achievable by this invention. The reason for this preferred size dimension is to encourage accuracy of aim and perception within a compressed environment but to the true dimensions of opposing players at a distance on the field.

Each panel should have an exposed main surface, a back surface and side edge surfaces. In one embodiment, the surfaces are substantially flat with a gritty texture and having no attachments or cavities on the exposed portions, and the main surface should have a perimeter border that is preferably white or metallic in color, the total combined surface area of the perimeter border being less than that of the main surface, optionally comprising less than fifty percent of the surface area of said exposed main surface. The remaining interior portion should have a color similar to a standard soccer field or arena. The typical color of a standard outdoor soccer field is green for sod grass, typically beige for indoor wooded floor panels and occasionally green for painted indoor soccer arenas. The reason for this color combination and pattern is to train the user's sense of perception and intuition to the standard effects of the game.

The exterior surface of the panel is comprised of a semi-viscous and semi-flexible textured material similar to rubber, latex or neoprene to create a dampening and gripping effect that is consistent in wet and dry conditions. The slight gripping effect or viscosity of the rubber like substance on the surface of the panel enables the user to manipulate the ball against the panel to create unique deflection and aim that may be recreated between multiple live players. The gripping effect is similar in texture and durability to a typical soccer player's shoes. The material forming the exterior surface of the panel can be utilized to form the entire panel, or the material forming the exterior surface of the panel can be affixed to an interior support structure for the panel. The interior material composition of each panel providing the support to the exterior surface that is attached to thereto in any suitable manner can be formed of any suitable material and would preferably be comprised primarily of wood, wood composite (or stiff organic fiber material such as bamboo) for its hardness and unique low reverberation effect. Reverberating sound from a surface upon impact can be a distracting element leading to unwanted sensory conditioning. Alternative solid materials may be used interchangeably and should be sufficiently dense to enhance the quality of deflection from the panel exterior surface while having minimal reverberation upon impact. The slight dampening effect particularly achieved by wood fiber material will also help limit wear and tear on the ball from extended use. Thus, the composition of the wall panel may include any of the following materials and is not limited to polycarbonates, plexiglass, metal, wood, foam, plastic, combinations of these materials or any future unknown material that achieves the described intended quality and purpose.

The wall or device in certain of the illustrated embodiments is embodied in two sizes, a larger and a smaller size. The smaller size embodiment is intended to train passing skills and will be referred to as a passing wall. The larger size embodiment is intended to train shooting techniques and will be referred to as a shooting wall. A passing wall is sized as desired and can be scaled to the size of an average adult player in ready position (standing with legs spread apart) would preferably have a height that is between two to three feet and a width that is approximately three and a half feet to four and a half feet. The size of the shooting wall may also be selected as desired and in one embodiment can range between three and a half feet to four and a half feet in height and approximately six to eight feet in width, proportional to a long distance perspective of a standard goal post from within ten yard of the player. The dimensions however may be proportionally smaller in alternative embodiments to accommodate the average dimensions of very young players.

The deflection panel is connected to a support assembly for purposes of stabilizing the panel on the ground and maintaining the device in an erect vertical position during use. The support assembly may be detachable and portable or permanently affixed to the panel and the ground by an anchor, which can form a part of the assembly. Material composition of the support assembly may comprise and is not limited to weather resistant metal, organic or inorganic fiber materials or plastic, or combinations thereof.

A permanent support assembly would be connected to the panel and further connected to an anchor that is embedded beneath the field surface. A support piece of the permanent support assembly detachably connects the panel to the anchor such that the panel would be permanently fixed in position when connected to the anchor in the ground, yet the panels themselves may be removed to avoid theft or weather. When in use, the separate components of the permanent support assembly are connected in position and a tight, rigid, immovable connection results. The sturdiness and rigidity should have no secondary affect (i.e. rattling, budging movement, etc.) upon rapid frequent high impact on the panels.

A portable support assembly provides for a panel that is connected to a support unit, the support unit further connected to a portable fixturing means (i.e. spike, stake, pad, suction, pin, etc.) This embodiment would not be permanently anchored to the ground or permanently positioned in any location but may be moved and positioned anywhere feasible. Material composition of the support and fixturing means may include any of the following durable and weather resistant material such as galvanized metal, organic or inorganic fiber, plastic, etc. A preferred embodiment of the fixturing means comprising a ring or hinge connected to a flat stake (preferably triangular and flat in shape) which swivels around the axis of an axle. The axle may be a detachable rod separately connected to the ring or it may be a portion of the ring itself. The axle (essentially a thin rod) is a means for keeping the stake attached to the support to minimize spare parts. The rotating or swivel feature of the axle and stake allows the stake to swivel into position for anchoring while remaining connected to the fixture unit. The continual connection between the axle and the stake allows the fixture to remain unitarily connected to the device as it is being used and in between use during transport. The swivel feature further allows the stake to flip away from the ground surface should the device be dragged along the ground during transport, minimizing damage to the field. The fixturing means may be removable from the support assembly such that when removed, the device may be staged or stationed within an indoor arena. When in use, fixturing means would be attached to the support assembly and the stake would be inserted into the ground. The stake would rotate or flip downward towards the solid support. Upon abutting the solid support, the stake is prevented from further movement. The abutment will occur and remain in place after the stake has penetrated into the ground surface. This stabilizes the panel and holds the entire device in rigid form against forceful frequent impact from the ball. No secondary affects (rattling, budging, etc.) should result from this manner of fixture.

The support assembly in either form can also be formed to enable the panel to be pivotable with respect to the support assembly while secured to the support assembly. By attaching the panel to the support assembly in a pivotal manner, the movement of the panel relative to the support assembly can be utilized to provide another level of modification to the use of the device including the panel and the support assembly.

Multiple units of two or more walls or devices may be erected and staged oppositely in modularized fashion. The opposing distance between any two passing walls can be configured as necessary, and in one embodiment should be approximately ten yards or less, but no less than three yards, for purposes of simulating true spatial parameters of the game in a compressed environment. Any distance beyond ten yards will begin to take on qualities of shooting and becomes less practical for training passing skills. In this embodiment, the adjacent distance between the side edges of neighboring passing walls should be no less than two yards to mimic the standard minimum spread between players in the game. These distance parameters follows best practice in the industry for training professional soccer skills but have been adjusted to accommodate individual training in a compressed environment. The manipulated dimensions of the module and device is engineered and designed to react to the individual user and create a simulated effect of high speed competitive interaction between players from close proximity. Additional walls may be positioned at an angle from the parallel rows of each module. Each added device will increase complexity by introducing new variables.

Multiple modules formed with various numbers of walls or devices may be staged adjacent to each other to create a personalized soccer training system. Players are able to control amount of complexity by adjusting the devices or walls within a particular module. As the user masters a particular set of challenges within a given module, the newly acquired skills are further put to the challenge in a new environment, such as that created by reconfiguring one or more of the walls in one or more of the modules. Progressive and controlled training through this type of modular system allows the user to become intimately familiar with otherwise unpredictable variables. This helps develop intuition in movement, speed, aim and accuracy. Mastering these basic skills allow the user to begin developing strategic control techniques. The results of which allow the user to remove some element of unpredictability from the game.

A complete modular training system may be erected within six square yards to forty square yards or more depending on the level of complexity aimed to be achieved and the types of modules set within, maximizing use of space and having a very small foot print on any field or arena. Portability of the device allows anyone to design a personalized modular training system and quickly position it in any location. The shape of the device further allows for manufacturability by of at least the exterior surfaces and/or the panels or the walls or devices by any suitable extrusion method.

The training device, method of use and modular training system provided herein does not exist in the art at this time. Current products within the market lack the embodiment and capability to encourage the type of professional skill development that is achievable with this invention. Other features, advantages, and object of the present invention will become more apparent and be more readily understood from the following detailed description, which should be read in conjunction with the accompanying drawings.

BRIEF DESCRIPTION OF THE DRAWINGS

The present invention is illustrated by way of example, and not by way of limitation, in the figures of the accompanying drawings and in which like reference numerals refer to similar elements. Unless otherwise indicated illustrations in the figures are not necessarily drawn to scale.

FIG. 4 is an isometric view from the back of the embodiment of the device of FIG. 1 comprising one panel and bracket support assembly, the device not drawn to exact scale or perspective;

FIG. 5A-5C are partially broken away isometric views along line 5-5 of FIG. 4 of the fixturing means of the support mechanism of the invention described herein in various positions, the device not drawn to exact scale or perspective;

DETAILED DESCRIPTION OF THE PREFERRED EMBODIMENTS

Reference will now be made in detail to exemplary aspects of the present invention which are illustrated in the accompanying drawings. Wherever possible, the same reference numbers will be used throughout the drawings to refer to the same or like parts.

Figure 1:
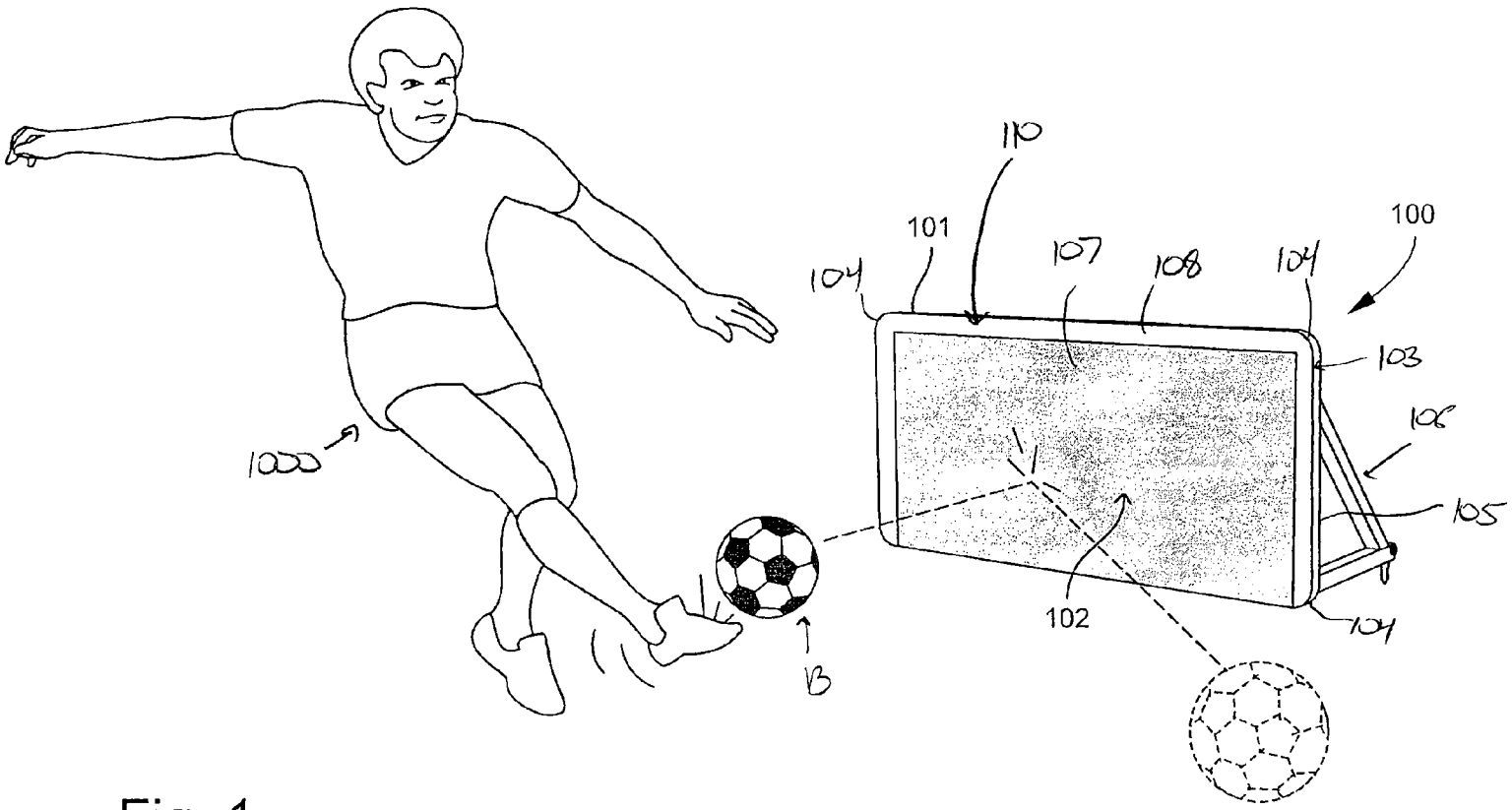
FIG. 1 is a perspective view of a panel of the device according to a first embodiment of the invention described herein, the device not drawn to exact scale or perspective.

FIG. 1 provides a general embodiment of the device of the present invention which is a deflection wall 100. The device in FIG. 1 is not drawn to scale and represents a generic illustrated description of the claimed features. The deflection wall 100 as illustrated having a panel 101 that has a rectangular shape, though other geometric shapes for the panel 101 are also contemplated as being within the scope of the present invention. The panel 101 includes an exposed front surface 102 that is formed to be flat, containing no attachments or cavities that would interfere with the interaction with a ball B striking the front surface 102 of the panel 101. The exposed front surface 102 is surrounded by a peripheral surface or edge 103 and has a greater surface area than the exposed side surface of the surrounding edge 103, such that the panel 101 is formed to be relatively thin across the edge 103 relative to the length and height of the remainder of the panel 101. The corners 104 of the panel 101 in the illustrated embodiment are formed with a curved profile such that deflection of a ball B from said corner would closely simulate a ball being kicked from the curve of a person's padded shoe as opposed to a hard jagged surface. The curved or rounded corners 104 further minimize wear and tear on a ball typically experienced with sharp or jagged edges. The panel 101 is placed with one of the long portions of the peripheral edge 103 directly on and perpendicular to the ground during use, and is secured in this position by a support assembly 106 connected to the panel 101.

The panel 101 also includes a rear surface 105 disposed opposite the front surface 102. The rear surface 105 can be formed similarly to the front surface 102, or can be formed of a material different than that of the front surface 102, as rear surface 105 is prevented from being struck by the ball B by the attachment of a support assembly 106 to the rear surface 105. The front surface 102 and the rear surface 105 can each be joined to the peripheral edge 103 in a manner that provides a generally seamless appearance to the panel 101, and optionally to enclose an inner support structure (not shown) positioned between the front panel and the rear panel 105 and within the peripheral edge 103 to provide support to the panel 101.

The front surface 102 is formed with an inner section or target 107 which makes up the majority of the front panel 102 and an outer section or border 108 disposed around the side and upper edges of the inner section 107. The inner section 107 and the outer section 108 are delineated, at least visually, from one another in the illustrated embodiment by making the inner section 107 a different color from the outer section 108. Additionally, alternatively or in combination with the different colors, the inner section 107 can be formed of a material different than that used to from the outer section 108. In this embodiment, the panel 101 can have the front surface 102, the peripheral edge 103 and the rear surface 105 formed from a suitable material, such as a plastic material, and the inner portion 107 can be affixed to the front surface 102 of the panel 101 in a suitable manner, such as by adhering or mechanically securing the inner portion 107 to the front surface 102. The inner portion 107 can be attached to the front surface 102 within a recess formed in the front surface 102 such that the inner portion 107 and the outer portion 108 form a planar configuration for the front surface 102 without any protruding components.

In the embodiment of FIG. 1, the panel 101 includes an outer coating 110 covering the entire panel 101, and enclosing an interior (not shown) of the panel 101. The coating 110 is comprised of a thick, semi-flexible and semi-viscous material, which can be similar to rubber or neoprene, and is extruded, poured, molded, painted, sprayed or otherwise positioned around the entirety of the interior of the panel 101 to form the exposed surfaces on the front surface 102, the peripheral edge 103 and the rear surface 105. Additionally, the coating 110 can be applied in one or more than layer in order to provide the desired properties to the exposed surfaces 102, 103 and 105 of the panel 101. One or more of the exposed surfaces 102, 103 and 105, and preferably the front surface 102, may be textured in suitable manner to enhance the contact of the surface of the panel 101 with the ball B striking the panel 101, e.g. the grip applied to the ball B by the surface, but should not have substantial grooves, cavities or raised features otherwise interfering with the planar nature of the surfaces of the panel 101 to detrimentally affect the simulated interaction provided by the panel 101. The interior of the panel 101 can be formed of any suitable material able to provide the desired rigidity to the panel 101, and can be substantially comprised of any solid material such as but not limited to wood, wood composite, plastic, glass, fiber-reinforced material, metal, foam, carbon fiber or any combinations thereof. The interior composition of the preferred embodiment would be comprised of wood or a wood composite material.

As stated above, the device may be embodied in two preferred sizes. A device 100 formed with a larger size is defined as a shooting wall 700,702 (FIGS. 7A and 7C), as it is designed to represent the area available for a player to shoot the ball B, and a wall formed with a smaller size is defined as a passing wall 701 (FIG. 7B), as it designed to represent the area in which a player can pass the ball B to a teammate. The shooting wall 700, 702 is formed to have a dimension capable of simulating the shooting area for a player, e.g., having a dimension proportional in perspective to a standard soccer goal post frame from a far distance, e.g., more than fifteen (15) feet. In one embodiment, the shooting wall 700, 702 is between three and a half (3.5) to four and a half (4.5) feet high from the support surface on which the device 100 rests, such as the ground or floor, and between six (6) to eight (8) feet wide. The passing wall 701 is formed to have a dimension proportional in perspective to simulating the silhouette of an average adult soccer player standing in ready position with legs spread apart to receive a pass. In one embodiment, the passing wall 701 is between two (2) to three (3) feet high from the support surface on which the device 100 rests, such as the ground or floor, and three and a half (3.5) feet to four and a half feet (4.5) wide. The two sizes for the shooting wall 700, 702 and the passing wall 701 may be scaled down to the proportional dimensions of average users of a particular age range such as shorter youth players or smaller infant-children players.

Figure 2:
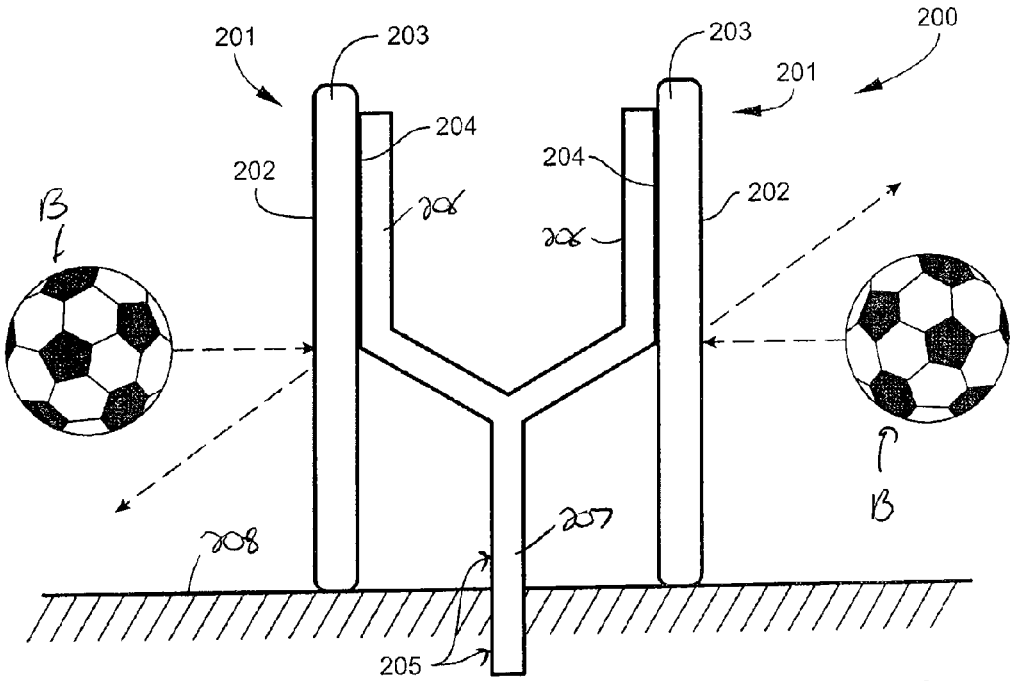
FIG. 2 is a side plan view of the device comprising two panels and a support assembly according to a second embodiment of the invention described herein, the device not drawn to exact scale or perspective.

FIG. 2 illustrates an alternative embodiment of the deflection wall 200 formed with two panels 201. Each panel 201 can be formed similarly to the panel 101, and can be formed similarly to or different from one another. In the wall 200, each panel 201 has one exposed front or main surface 202, a substantially exposed peripheral edge surface 203, all but the bottom which is in contact with the supporting surface, e.g., the ground, and an obstructed back or rear surface 204. The back surfaces 204 face and are secured in a suitable manner, such as any fixed or releasable mechanical connection, to a central stabilizing unit 205 which can be formed of any suitable material. The stabilizing unit 205 has a pair of arms 206 that extend away from one another and are directly secured to the back surfaces 204 of the panels 201. The arms 206 are connected to a surface-engaging portion 207 that can be inserted into or otherwise engaged with the surface 208, e.g., the ground, on which the panel 201 is positioned. Further, one or more of the stabilizing units 205 can be secured between the panels 201 to provide the desired functionality to the device 200. With this construction, the device 200 is fully usable from both sides of the device 200. In addition, the device 200 may have more than two panels 201 secured thereto.

Figure 3:
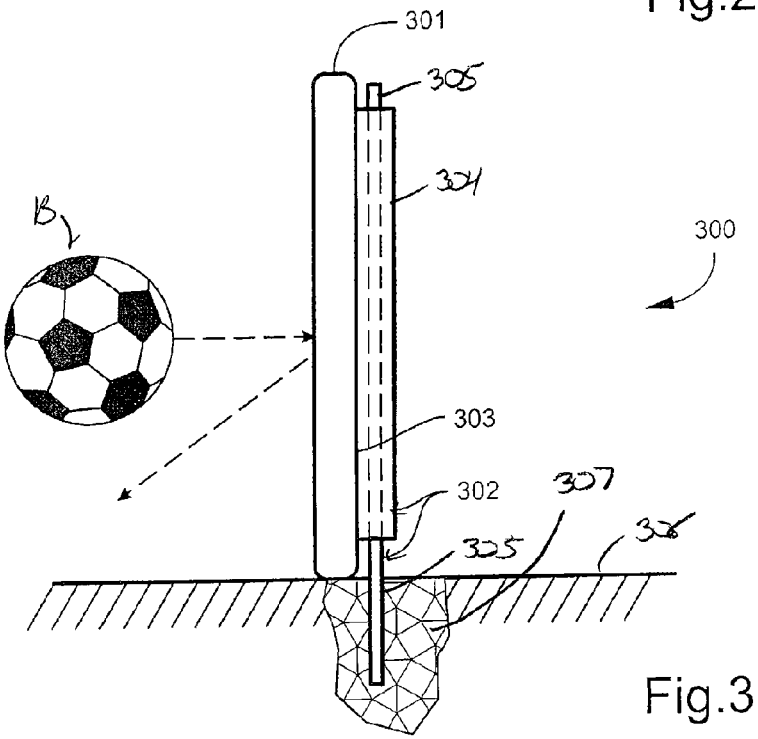
FIG. 3 is a side plan view of a third embodiment of the invention described herein, the device not drawn to exact scale or perspective.

FIG. 3 illustrates another alternative embodiment of the device 300 which includes a single panel 301 formed similarly to the panel 101 and having an anchor support assembly generally illustrated in the drawings at 302. The support assembly 302 includes a support channel or sleeve 304 connected to the back surface 303 of the panel 301, and support rod 305 fixed in the ground 306 to an anchor 307, formed of a suitable material, such as concrete, disposed below the surface of the ground 306. To secure and stabilize the panel 301 in an erect position above ground 306 for use, the rod 305 can be inserted into the sleeve 304 to hold the panel 301 in position over the ground 306. One or more support or support assemblies 302 may be connected to a particular panel 301 to provide the desired amount of support to the panel 301, particularly in light of the size and composition of the panel 301 the ground surface composition. The embodiment of FIG. 3 illustrates one of many potential manners of construction known in the art and should not be read in a limiting fashion.

FIGS. 4, 5A and 5B illustrates another embodiment of the device 400 having one panel 401 attached to a support assembly 402. FIG. 4 illustrates a side view of this embodiment of the device in which the support assembly 402 comprises two angled brackets 403 secured to the rear surface 405 of the panel 401, with each bracket 402 having a fixturing means 404 connected thereto generally opposite the panel 401. The angled bracket 403 forming the support assembly 402 may comprise any hard weather resistant material such as but not limited to stainless or galvanized steel, durable plastic, carbon fiber or any combination of such material. The bracket 403 may be secured to the panel 401 in any suitable manner, such as by mechanical fasteners, and can be movably attached to the back surface 405 of the panel 401, such that the brackets 403 can be pivoted between the use position in FIG. 4, and a collapsed position where the brackets 403 are disposed generally parallel to the back surface 405 for ease of transport, or can be detachable from the panel 401 as a separate component for transport. The support assembly 402 is not limited to an angled bracket means 403 but may include any similar manner of structural and stabilizing support of the panel 401 in a vertical upright position over a support surface, such as a soccer field or arena.

In one embodiment, the brackets 403 forming the supporting assembly 402 would be attached to the panel 401 without holes or protrusion through any exposed surfaces of said panel 401, such as but not limited to nails and screws. Further, the connection between parts of the device 400 in whole and upon fixture to the ground surface for intended use should be substantially sturdy and having minimal movement or noise, particular upon forceful impact. Unwanted sounds or deflection interaction arising from the wall upon impact may negatively affect psychological aspects of training, resulting in secondary unwanted habits or else simply interfering with the overall focus of training. The choice of material, composition and design of attachment features, many of which are already known in the art, can be chosen to minimize this unwanted effect.

FIG. 4 illustrates the back side 405 view of an embodiment having two triangular brackets 403 attached to the back surface 405 of a panel 401. Each angled bracket 403 recessed approximately seven to ten inches inward from the edges 406*a* of the panel sides so as to minimize obstruction to a soccer ball trajectory path. The angled bracket 403 has a horizontal piece 407 resting above the ground surface and extends perpendicularly from the bottom edge 406*b* of the back surface 405 on a horizontal plane relative to the ground surface. In one embodiment, said horizontal piece 407 is connected to the back surface of the panel 401 approximately half an inch (0.5) above the bottom edge of said panel 401 and extends outward at a perpendicular ninety degree angle as seen from a side view when the bracket 403 is in an open standing position. The purpose of the half inch lift above the bottom edge of the panel 401 is to create a pivot between the bottom of the panel 401 and the bracket 403 as the entire assembly rests against the horizontal ground surface. This slight pivot of the panel 401 rearwardly against the bracket 403 creates a resistance against the ground that is necessary to prevent the heavy wall from collapsing to the ground upon forceful impact of a high speed ball B. Without this said pivot, the wall would more likely collapse under its own weight (which is between eighty (80) to one hundred (100) pounds for the shooting wall and thirty (30) to forty-five (45) pounds for the passing wall) upon forceful impact of a ball should the wall be positioned at least close to perpendicular to the horizontal ground surface. The weight of the walls themselves should be heavy enough to withstand high frequency forceful impact of the ball without any slight movement of its position. Accordingly, the ideal weight of the wall should be within the range provided immediately above. Further, given the inherent balancing issues with a large heavy wall, the slight pivoting of the bracket pieces described above secures the walls in position according to their intended use and application. The brackets 403 also include a tangential piece 409 secured to the horizontal member 407 generally opposite the rear surface 405 of the panel 401. The panel 401 includes a vertical rail 408 formed on the and extending rearwardly from the back wall surface 405, which, when connected to the horizontal piece 407 and the tangential piece 409 of the bracket 403 create a triangular shape as illustrated in the drawings, which provides a high degree of stability to the panel 401 when in use. The horizontal 407 and tangential 409 pieces preferably comprised of weather resistant metal, though other suitable materials are also contemplated as being within the scope of the present invention.

Figure 6A:
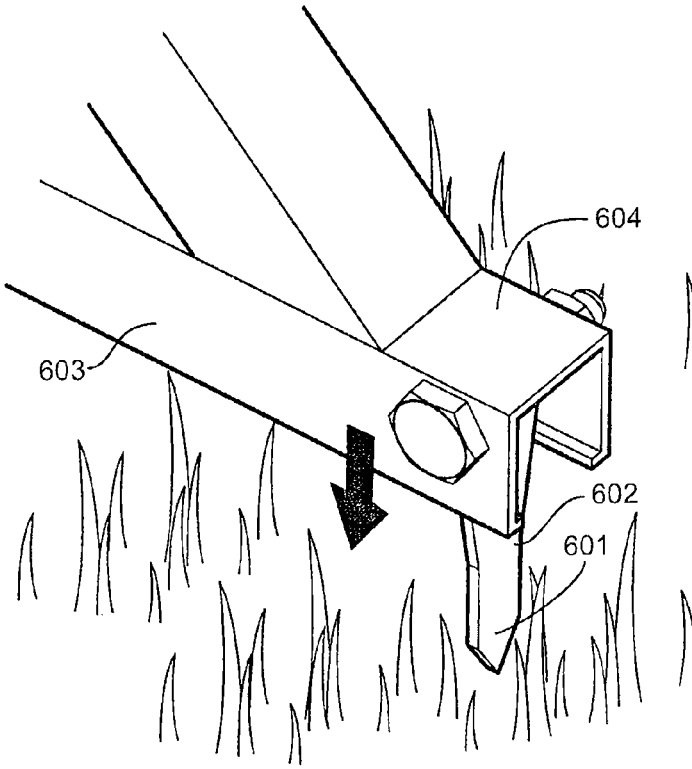
FIG. 6A-6B are partially broken away isometric views of the fixturing means of the support mechanism of the invention described herein being engaged with a support surface, the device not drawn to exact scale or perspective.
Figure 6B:
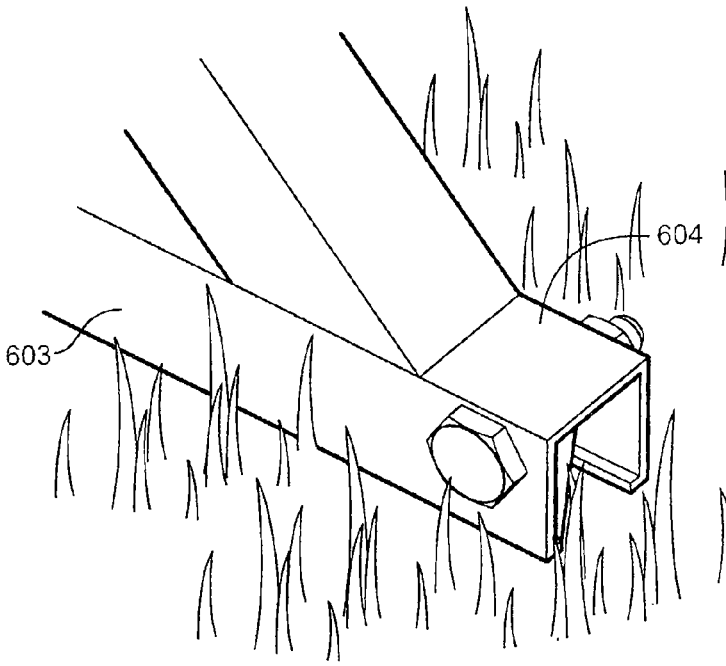
Figure 6C:
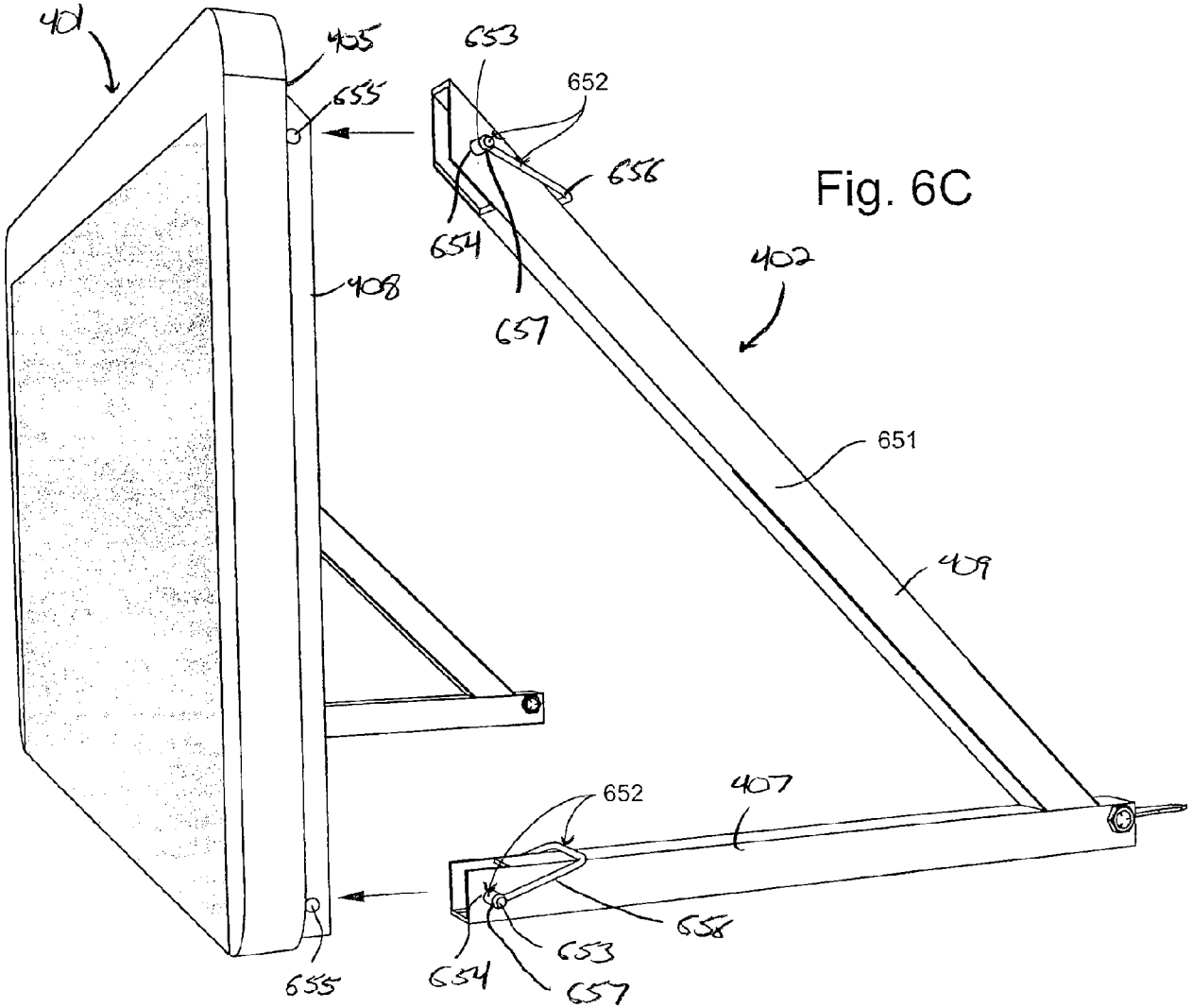
FIG. 6C is a perspective view of the device of FIG. 4 of the invention according to the description herein, the device not drawn to exact scale or perspective.

Referring now to FIGS. 4 and 6C, further illustrates a portable detachable version of the angled support brackets 651 wherein the brackets 651 may be attachable and detachable by a spring lock or clip mechanism 652. The lock mechanism 652 includes a pin 653 that insertable through pairs of openings 654 formed in the horizontal piece 407 and the tangential piece 409 that can be align with channels 655 formed in the rails 408. The pins 653 can be secured within the openings 654 and channels 655 by a clip 656 pivotally secured to one end of the pin 655 and having an aperture 657 at the opposite end that is positionable over the opposed end of the pin 655.

Figure 14:
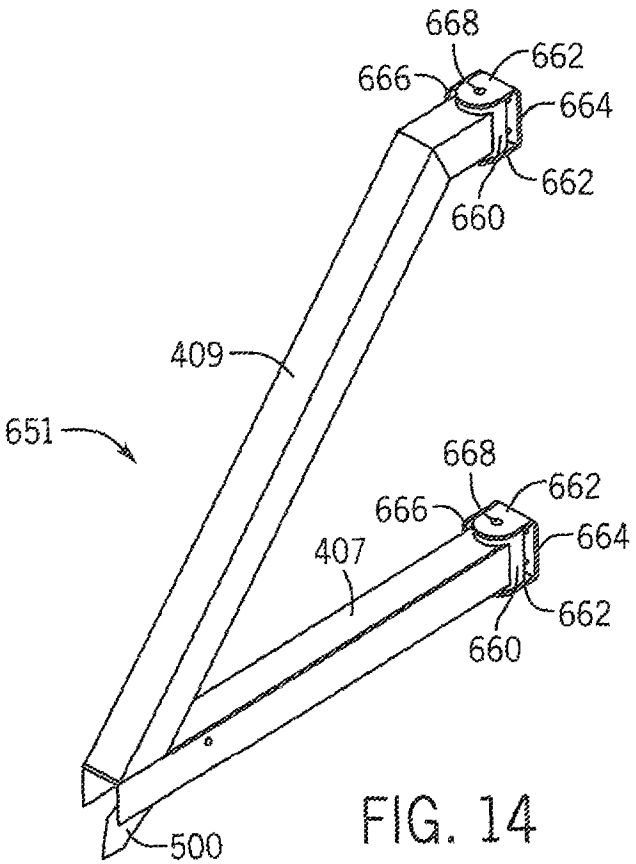
FIG. 14 is an isometric view of another embodiment of a panel support assembly for use with the device of FIG. 4.
Figure 15:
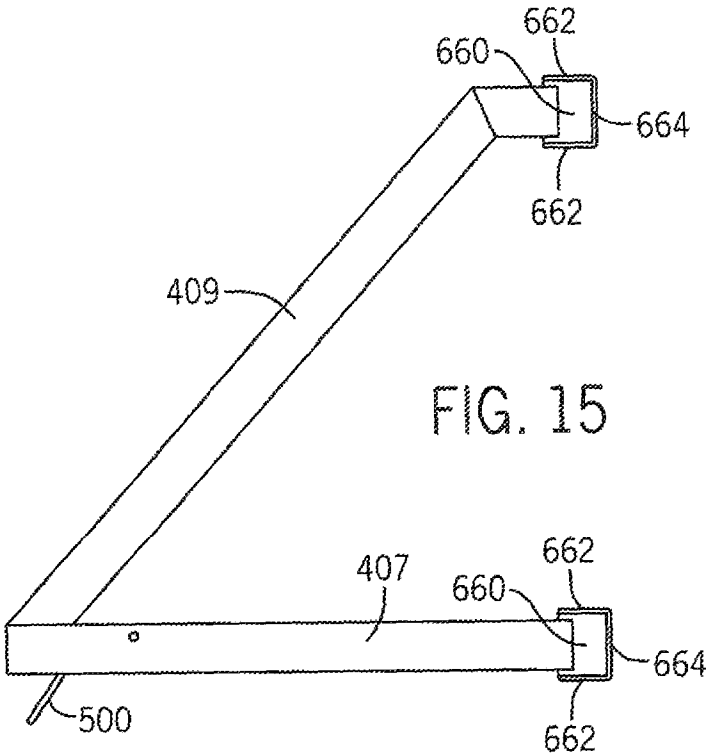
FIG. 15 is a side plan view of the support assembly of FIG. 14.
Figure 16:
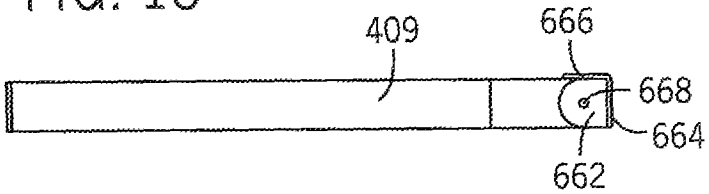
FIG. 16 is a top plan view of the support assembly of FIG. 14.

An alternative embodiment of the bracket 651 is shown in FIGS. 14-16. In this embodiment, the bracket 651 includes the horizontal piece 407 and the tangential piece 409 connected to one another, and optionally including brace members extending therebetween and/or between spaced brackets 651, along with a fixturing means 500 (FIGS. 14 and 15) pivotally secured thereto. The end of the horizontal piece 407 and the tangential piece 409 engaged with the panel 401 include vertically-oriented sleeves 660. Within each sleeve 660 is disposed a shaft 668 that is connected at each end to a flange 662 extending from opposed ends of a fixing bracket 664. The bracket 664 also includes a stop 666 extending from one side of the bracket 664 and connected between the flanges 662. The bracket 664 is connected to the rear surface 405 of the panel 401 in any suitable manner hold the bracket 664 on the panel 401. However, as the shaft 668 is rotatable within the sleeve 660 on the bracket 651, the bracket 651 can rotate with regard to the bracket 664 and the panel 401. In this manner, the bracket 651 can be rotated from an extended position where the bracket 651 contacts the stop 666 on each bracket 664 to a collapsed position where the brackets 651 are positioned generally against the rear surface 405 of the panel 401. Further, in the collapsed position, as a result of the dimensions of the brackets 651, the brackets 651 are positioned coplanar with one another, such that the brackets 651 do not touch or interfere with one another in this position. The brackets 651 can also optionally be locked in either position by a suitable locking member (not shown) engaged between the sleeve 660 and the shaft to prevent their rotation with regard to one another.

A fixturing means 404,500 according to FIGS. 5A, 5B and 5C is connected to the joint end 501 where the horizontal piece 502 and tangential piece 503 meets. An exploded view of the fixturing means 500 as illustrated in FIGS. 5A, 5B and 5C comprising a flat triangular wedge 504 whose wider end 505 contains a hollowed sleeve or tubular portion 506 (shown in part) within whereby a link, bolt or thin axle rod 510, or any equivalent thereof, is slid through said sleeve 506 such that the wider side of the wedge 504 swivels around the link or rod 510 in the direction shown by arrow 507. The fixturing means 500 is connected to the horizontal piece 502 at the joint end 501 such that it may swivel around the axis of the horizontal piece.

When in use according to FIGS. 6A and 6B, the pointed end 601 of the flat wedge 602 is positioned downward perpendicular to the ground surface and perpendicular to the cross section of the horizontal piece 603 at the joint end 604. The wedge 602 is then driven into the ground with the flat side buttressing or abutting a blunt end (see FIG. 5A, 509) of the horizontal piece 603. The abutment of the flat wedge 602 against the blunt end 509 of the horizontal piece 603, as illustrated in FIG. 5A, prevents the wedge from rotating further along the axle rod thus stabilizing the device against forceful impact.

Figure 7A:
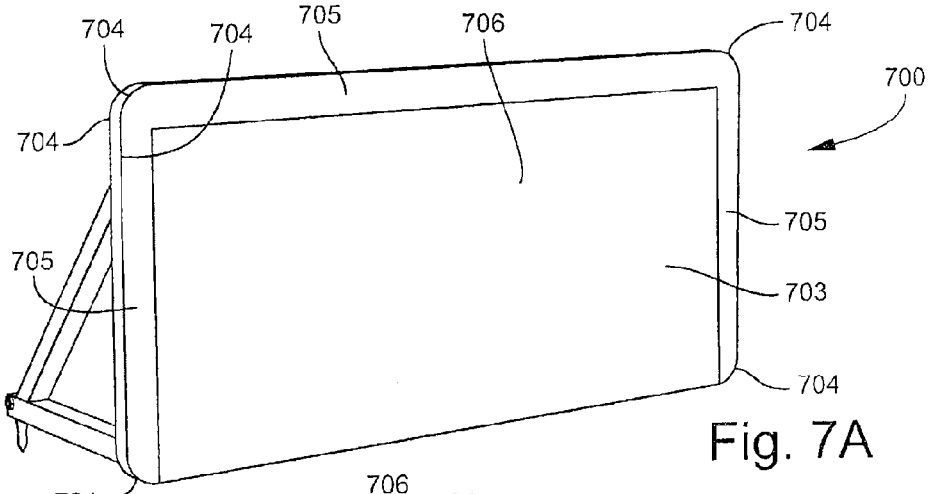
FIG. 7A is a perspective view of the device of FIG. 4 according to the description herein, the illustration is not drawn to exact scale or perspective.
Figure 7B:
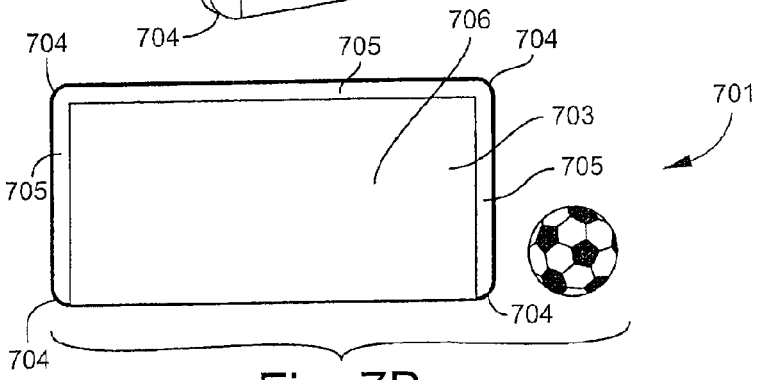
FIG. 7B is a front plan view of an alternative configuration of the device of FIG. 4 according to the description herein, the illustration is not drawn to exact scale or perspective.
Figure 7C:
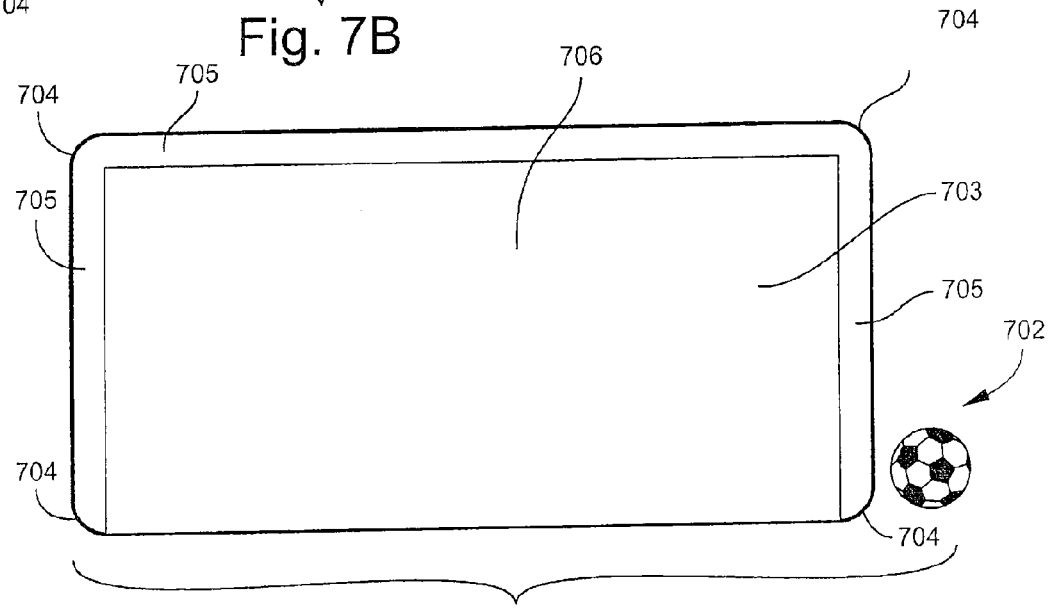
FIG. 7C is a front plan view of still another alternative configuration of the device of FIG. 4 according to the description herein, the illustration is not drawn to exact scale or perspective.

FIGS. 7A, 7B and 7C illustrating the exposed front or main surface 703 of some preferred embodiments of the device 700, 701, 702. FIGS. 7B and 7C illustrating a larger device 702 and smaller device 701 which are versions of the panel device 700. The devices are not drawn to exact scale but are drawn to relative scale as intended for an adult user and a standard goal post. The exposed front surfaces 703 of each panel 700, 701 and 702 are formed similarly to that of panel 101 and each have soft rounded or curved corners 704, a white colored border 705 comprising less than fifty (50) percent of the surface area of the exposed main surface 703, and more preferably less than ten (10) percent of the total surface are of the exposed front surface 703. The central area or portion 706 of the exposed main surface 703 within the perimeter of the white border 705 is preferably formed to have a color mimicking a real soccer field or arena such as tan, beige, brown or green.

Figure 8A:
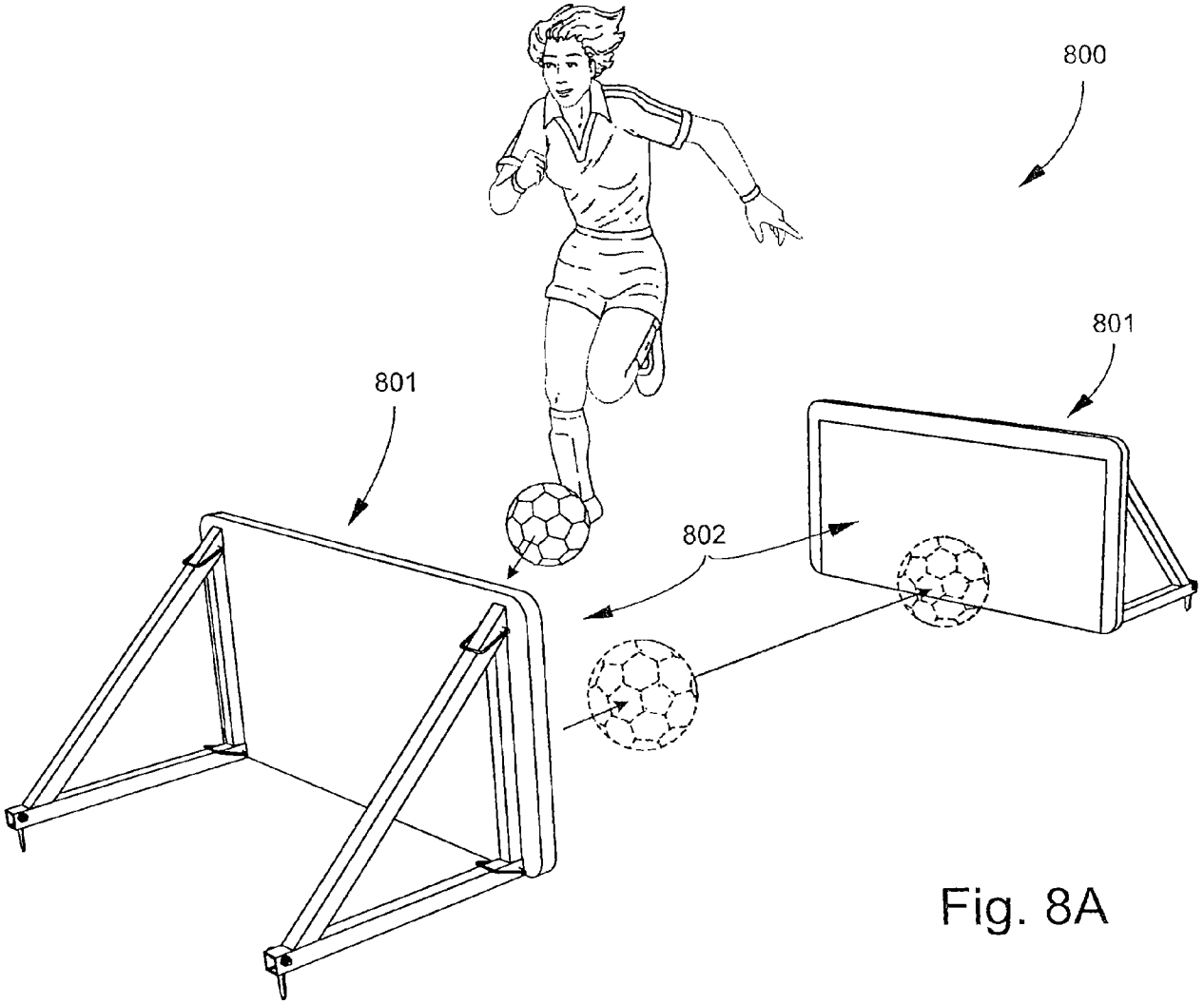
FIG. 8A is an isometric view of a first embodiment of a module formed with the devices of FIG. 4 according to the description herein, the illustration is not drawn to exact scale or perspective.
Figure 8B:
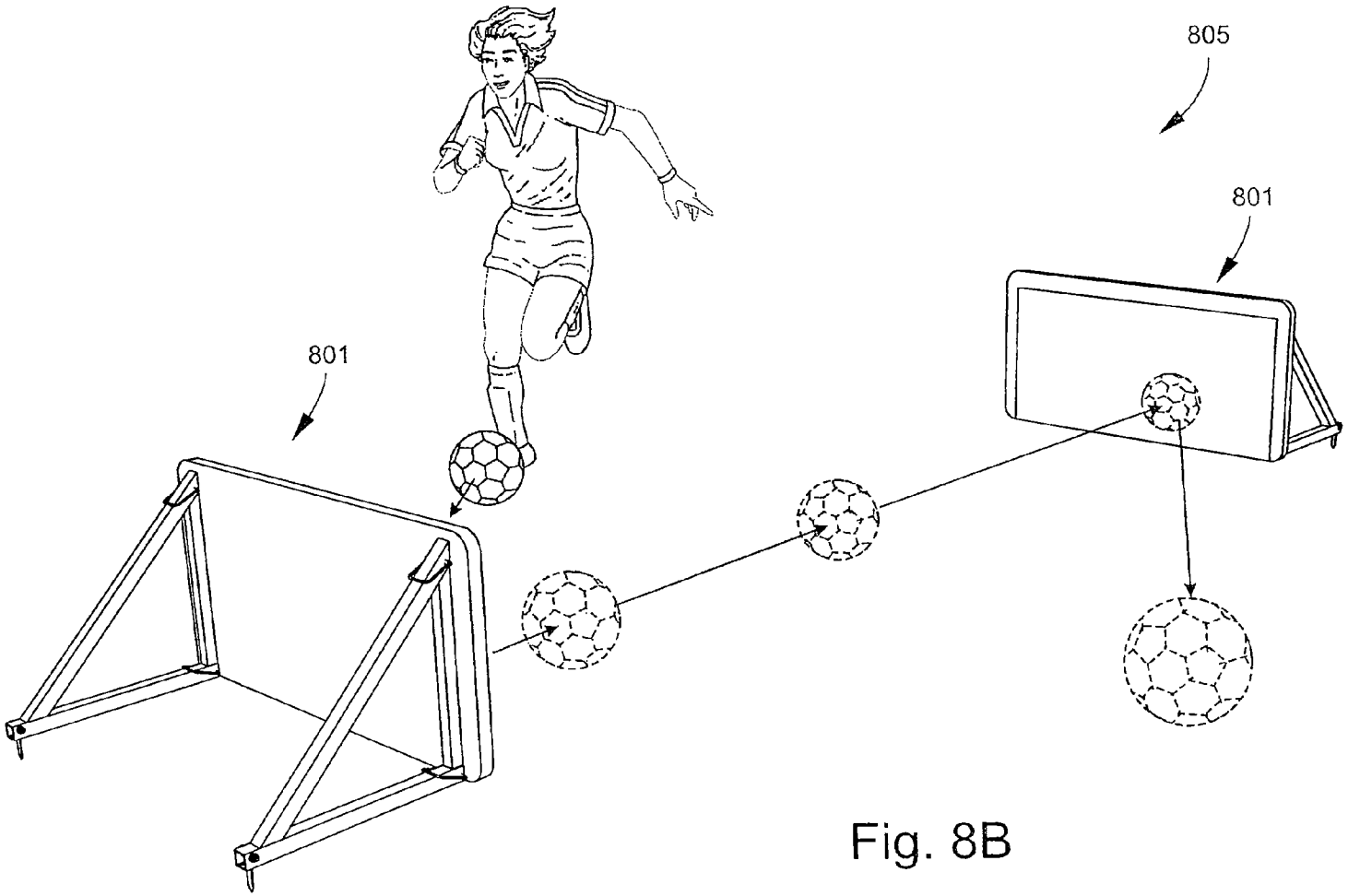
FIG. 8B is an isometric view of a second embodiment of a module formed with the devices of FIG. 4 according to the description herein, the illustration is not drawn to exact scale or perspective.

FIG. 8A illustrates a soccer training module 800 comprising two smaller passing walls 801 wherein each respective exposed main or front surface 802 is positioned directly opposite from each other. FIG. 8B illustrates an alternative embodiment of a two passing wall 801 module 805 that is spaced further apart. Variations in the distance between passing walls will vary but should be ten (10) yards distance or less from one another as a rule for purposes of mimicking actual distance between players within close practical passing range according to standard practice in the game of soccer. This range of distance further facilitating and encourage rapid, high repetition passing interaction between the player and the passing walls. FIGS. 8A and 8B are not drawn to scale or perspective.

Figure 9:
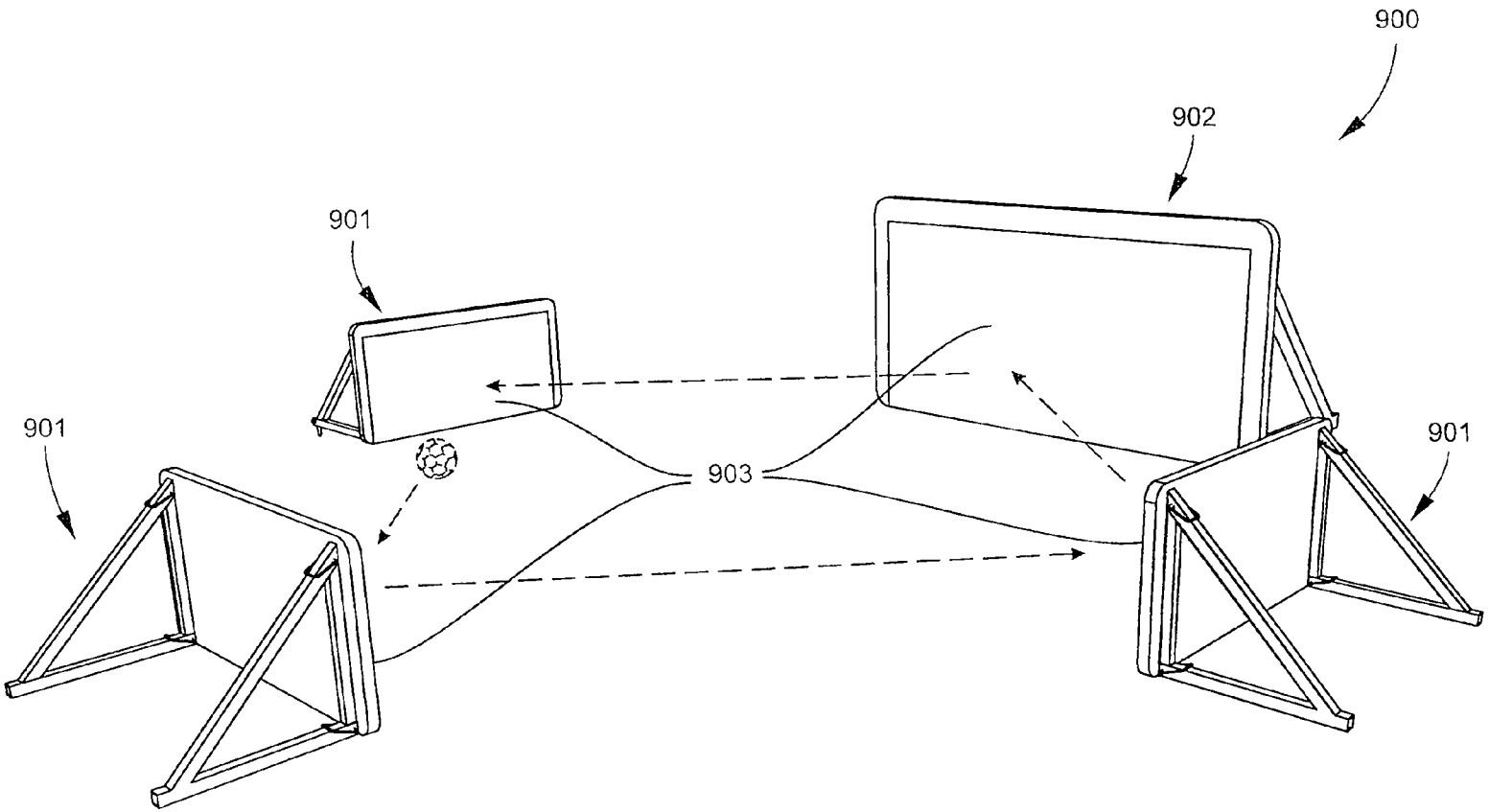
FIG. 9 is an isometric view of a third embodiment of a module using the devices of FIG. 4 according to the description herein, the illustration is not drawn to exact scale or perspective.

FIG. 9 illustrates a more complex soccer training module 900 having three passing walls 901 and one shooting wall 902, whose exposed main surfaces 903 are centrally facing wherein the combination of panels 901, 902 are oriented to create a rectangular or square pattern with a central area 903 defined therebetween. This configuration and other module configurations may be embodied in permanent attachments to the ground surface by way of an anchor support assembly or system, as described previously regarding prior embodiments of the panels 901, 902. FIG. 9 is not drawn to scale or perspective either. Alternatively, the shooting wall 902 and one or more of the passing walls 901 can be oriented to be parallel to one another, optionally with the parallel shooting wall 902 and the passing wall 901 in the same vertical plane above the supporting surface, e.g., the ground.

Figure 10:
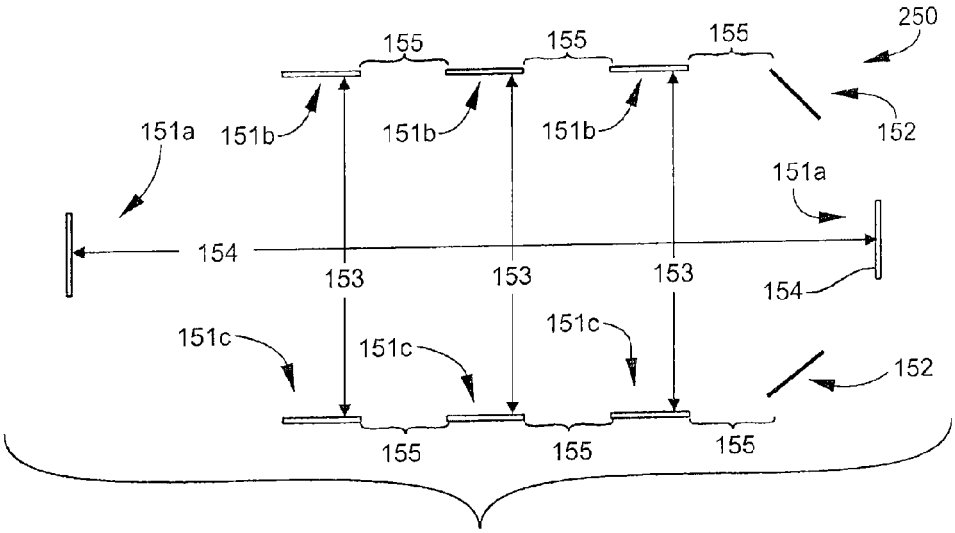
FIG. 10 is a top plan view of a fifth embodiment of a module according to the description herein, the illustration is not drawn to exact scale or perspective.

FIG. 10 illustrates an even more complex embodiment of a soccer training module 250 having eight permanently positioned devices 151*a, b, c* with two additional portable devices 152 in angled positions. This embodiment of the module having three pairs of passing walls 151*b, c* and one pair of shooting walls 151*a*, simulating a complete multiplayer game environment. The three pairs of passing walls 151*b, c* are positioned opposite to each other in parallel form, with two rows of three passing walls 151*b, c*. The pair of shooting walls 151*a* is positioned opposite each other between the two rows of passing walls 151*b*, and at each ends of the two rows. The eight walls 151*a, b, c* form a generally rectangular shaped module 250. The distance 153 between the exposed main surfaces of the two rows of passing walls 151*a, b, c* (along the length of the rectangle between exterior surfaces of the two opposing walls) is approximately eight (8) yards. The distance 154 between the opposing shooting walls 151*a* is approximately thirty-two (32) yards. The distance between adjacent passing walls within a given row (from side edge 155 to side edge 155) is approximately two (2) yards or greater.

Figure 11:
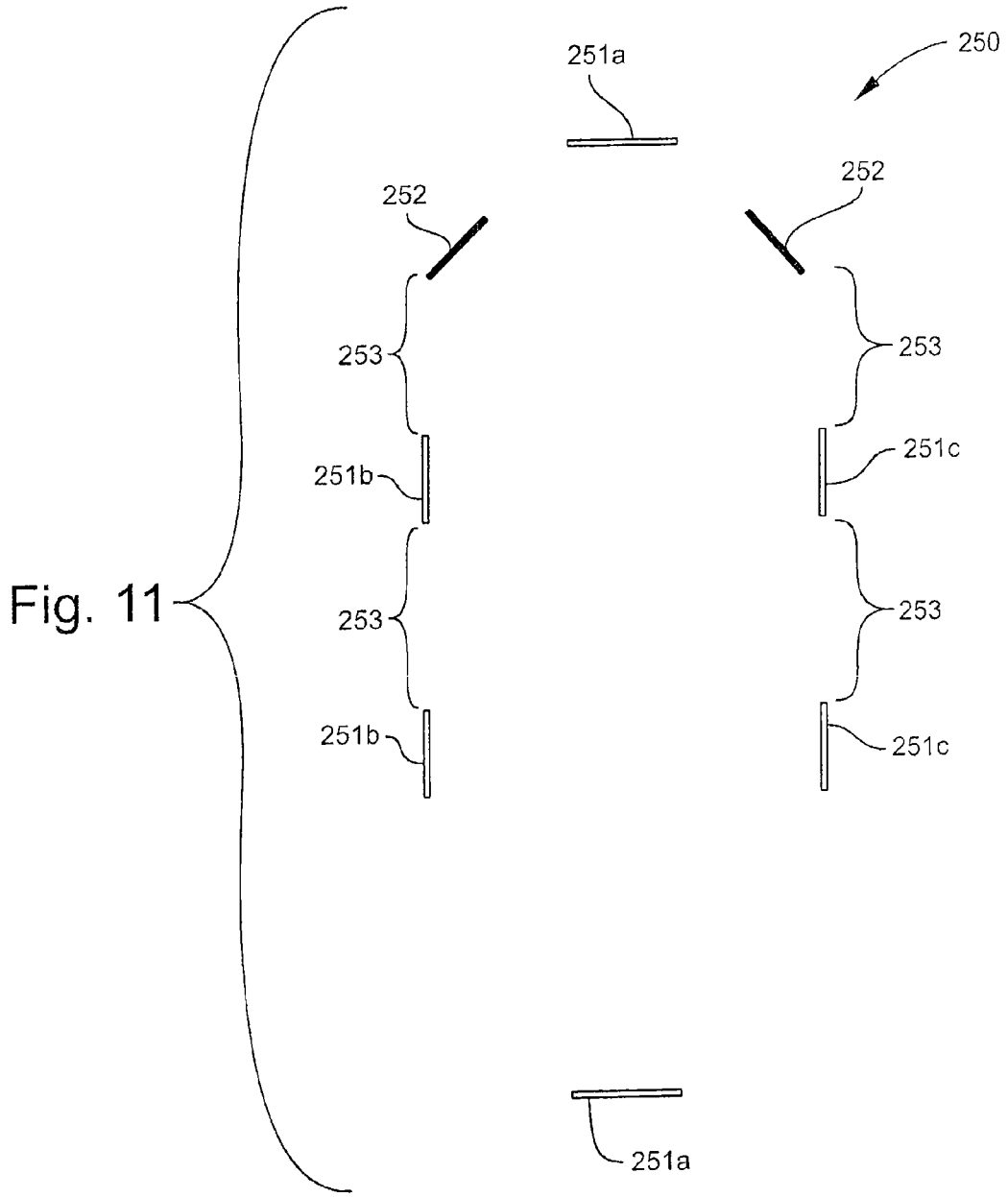
FIG. 11 is a top plan view of a sixth embodiment of a module according to the description herein, the illustration is not drawn to exact scale or perspective.

FIG. 11 illustrates an alternative embodiment of a complete field module 250 with six permanently fixed devices 251*a, b, c* and two portable devices 252 in an angled position. The distance between side edges 253 of the passing walls within the same row 250*a,c* remains at least two (2) yards of separation at a minimum, mimicking the natural minimum spread between players in actual play according to standard practice and training of the game.

Figure 12:
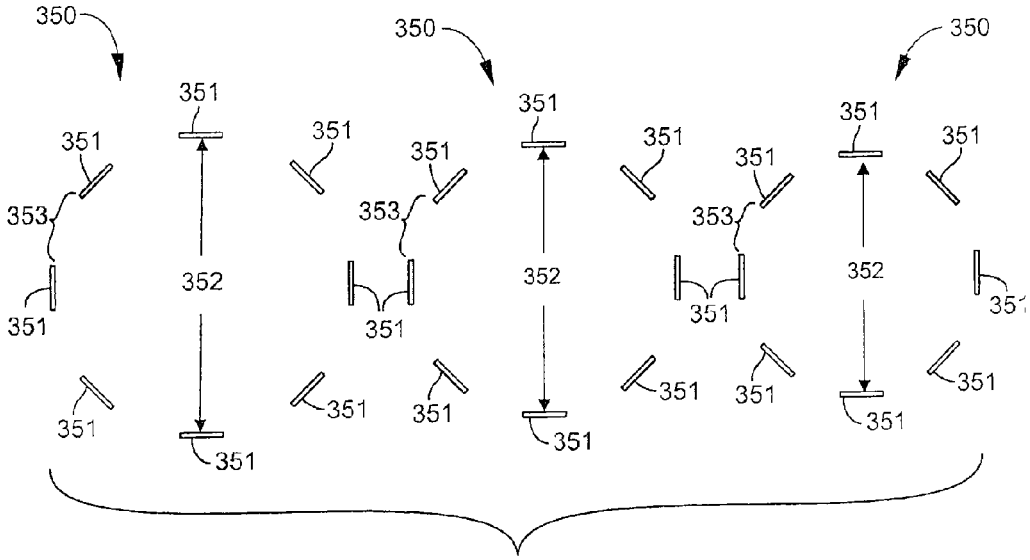
FIG. 12 is a top plan view of a seventh embodiment of a module according to the description herein, the illustration is not drawn to exact scale or perspective.

FIG. 12 illustrates three circular modules 350, each module containing eight passing walls 351, the exposed front surface of each passing wall 352 centrally facing the same central radial point to form a substantially circular or oval pattern. The distance between side edges 353 of the passing walls remains at least two (2) yards of separation at a minimum, mimicking the minimum natural spread between players in actual play according to standard practice and training of the game.

Figure 13:
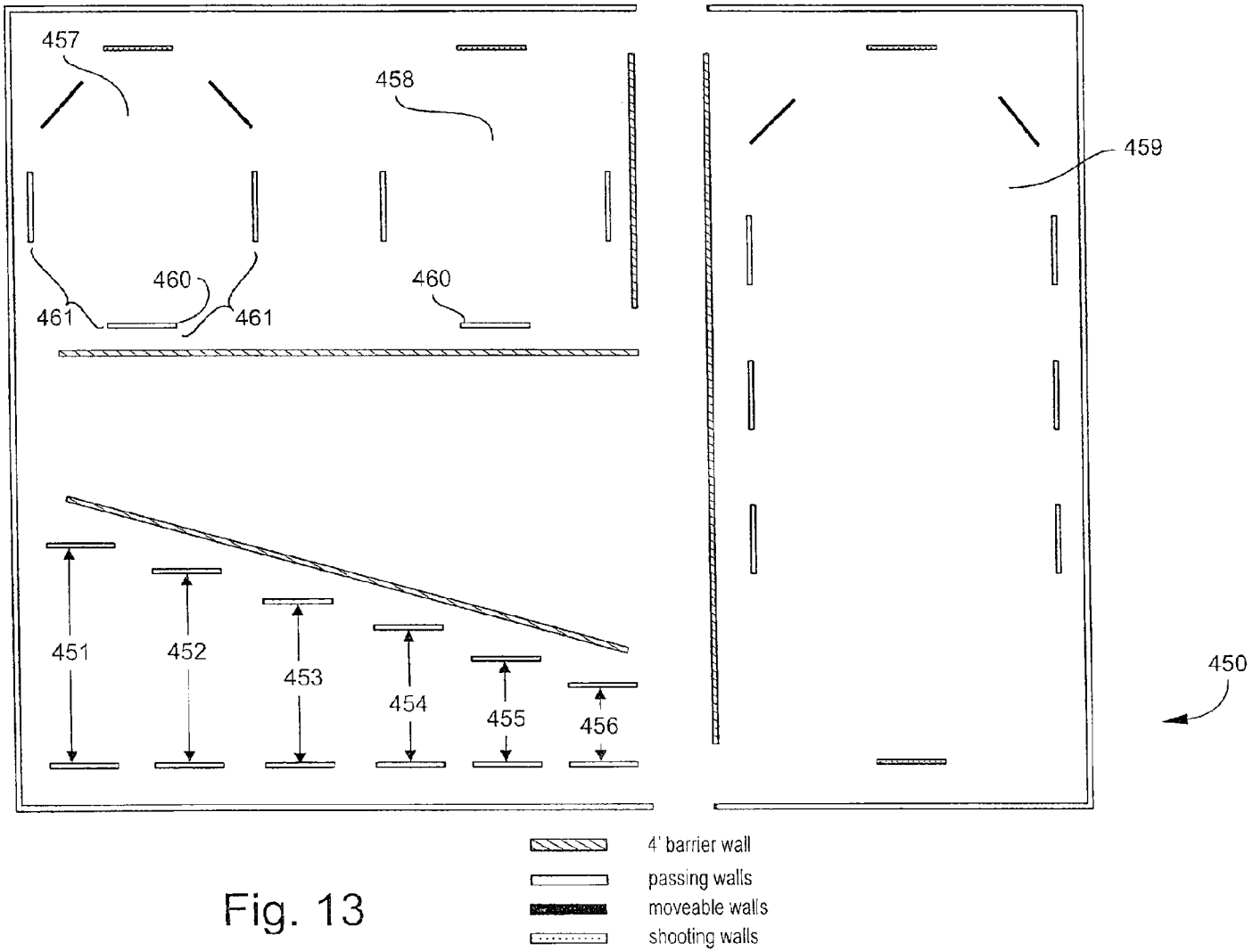
FIG. 13 is a top plan view of one embodiment of a complete modular training system according to the description herein, the illustration is not drawn to exact scale or perspective.

FIG. 13 illustrating one embodiment of a complete soccer training system 450 having nine sets of modules 451, 452, 453, 454, 455, 456, 457, 458, 459 of progressive levels of complexity. The first six sets of modules 451, 452, 453, 454, 455, 456 represent the least complex types, each containing two passing walls. The distance between the exposed front surface of the opposing passing walls within each of the first six modules are as follows: Module 1(451)=10 yards; Module 2 (452)=9 yards; Module 3 (453)=8 yards; Module 4 (454)=7 yards; Module 5 (455)=6 yards; Module 6 (456)=5 yards. These distances reflect the closest range of separation between players in passing position in actual play according to standard practice and training within the game of soccer. Any distance further than ten (10) yards would require shooting of the ball and detract from training passing techniques, and any distance of less than two (2) yards is too close for this type of training, with three (3) yards being a more desirable minimum distance.

Modules 7 (457) and 8 (458) of FIG. 13 represents the next progressing levels of modular complexity. These two sets each contain four permanent devices with three passing walls and one shooting wall. Both module units contain three passing walls and one shooting wall. The dimensional requirements of Module 7 & 8 are as follows: two passing walls in opposing position with the respective exposed surfaces separated by approximately seven (7) yards distance; one passing wall perpendicularly positioned 460 between the two passing walls at approximately two (2) yards distance between side edges 461; a shooting wall perpendicularly positioned relative to the two opposing shooting walls on the opposite end from the perpendicular passing wall 460; the shooting wall separated from the perpendicularly positioned passing wall 461 at approximately fourteen (14) yards distance. Portable devices or walls may be added to existing permanent modules to increase complexity of training.

The last module 9 (459) of this system 450, is substantially similar to the complete field module described in FIG. 10 or 11. Alternative modular embodiments, such as the type described in FIG. 12, may be added or substituted for any of the modules described within FIG. 13. The described training system and modules described above may be reconfigured to add extra levels of complexity by adding more devices at desired position on an existing modular environment. Alternative embodiments of the system may comprise less numbers of module units or fewer training levels. The described training system and module units may be permanently affixed onto a dedicated field or may be transported and movable anywhere along a field. The claimed device may be manufactured with either manner of construction in mind.

Figure 17:
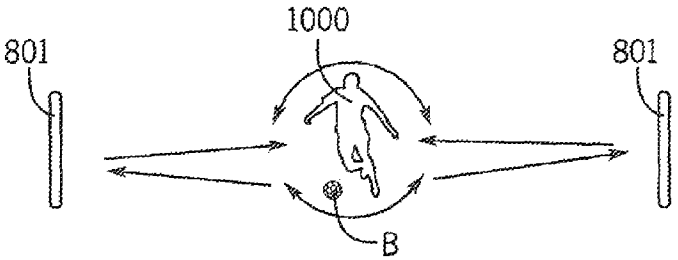
FIG. 17 is a schematic view of a method of using the modules of FIGS. 8A-8B and 13.

Referring now to FIG. 17, a schematic view of the method of use of the modules 800 of FIGS. 8A and 8*b*, as well as modules 451-456 of FIG. 13 is shown. In one embodiment of the method of using the modules 800, 451-456 the method, a player 1000 is positioned between the walls and can perform one of two exercises:

1) player 1000 can pass the ball B against one of the walls, receive the ball B as it rebounds off of the wall, and then turn 360° to pass the ball B back at the same wall, and repeat this process; or
2) player 1000 can pass the ball B against one of the walls, receive the ball B as it rebounds off of the wall, and then turn 180° to pass the ball B to the opposite wall, and repeat this process.

As the skill of the player 1000 in controlling the ball B as it rebounds off of the walls increases, the player 1000 can move to modules 800, 451-456 having progressively wider spaces between the walls, such that the passes become more difficult to make and receive accurately, and so that the player 1000 can incorporate making realistic in-game moves, e.g., dribbling and juking or evading, prior to making and/or receiving the passes against the walls of the modules 800, 451-456.

Figure 18:
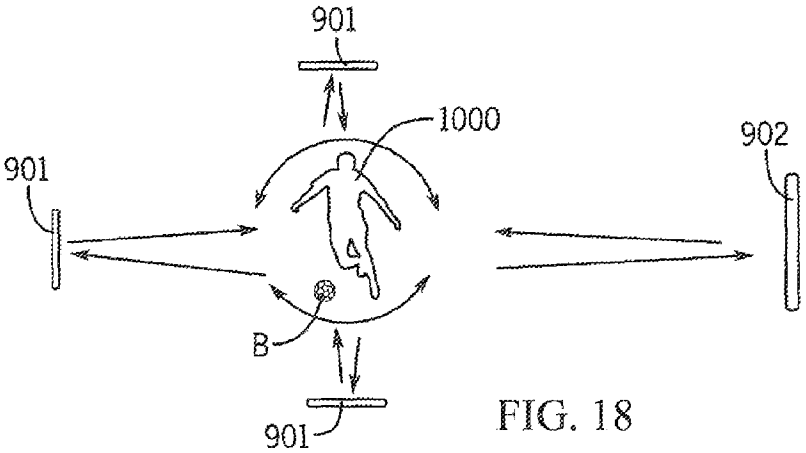
FIG. 18 is a schematic view of a method of using the modules of FIGS. 9 and 13.

Looking now at FIG. 18, a schematic view of the method of use of the module 900 of FIG. 9, as well as modules 457-458 of FIG. 13 is shown. In one embodiment of the method of using the modules 900, 457-458 the method, a player 1000 is positioned centrally within the walls and can perform these exercises:

1) player 1000 can pass the ball B against one of the passing walls, receive the ball B as it rebounds off of the wall, and then turn 90° or 180° or 360° to pass the ball B back at the same wall, or at one of the other passing walls in the triangular passing wall configuration and repeat this process; or
2) player 1000 can pass the ball B against one of the passing walls, receive the ball B as it rebounds off of the wall, and then turn 180° to shoot the ball B at the shooting wall, receive the ball B as it rebounds off of the shooting wall and the turn to pass the ball off of one of the passing walls, and repeat this process.

As the skill of the player 1000 in controlling the ball B as it rebounds off of the walls increases, the player 1000 can move to modules 900, 457-458 having progressively wider spaces between the passing and shooting walls, including being able to move certain portable walls present in the modules 900, 457-458, such that the passes and/or shots become more difficult to make and receive accurately, and so that the player 1000 can incorporate making realistic in-game moves, e.g., dribbling and juking or evading, prior to making and/or receiving or collecting the passes and shots against the walls of the modules 900, 457-458.

Figure 19:
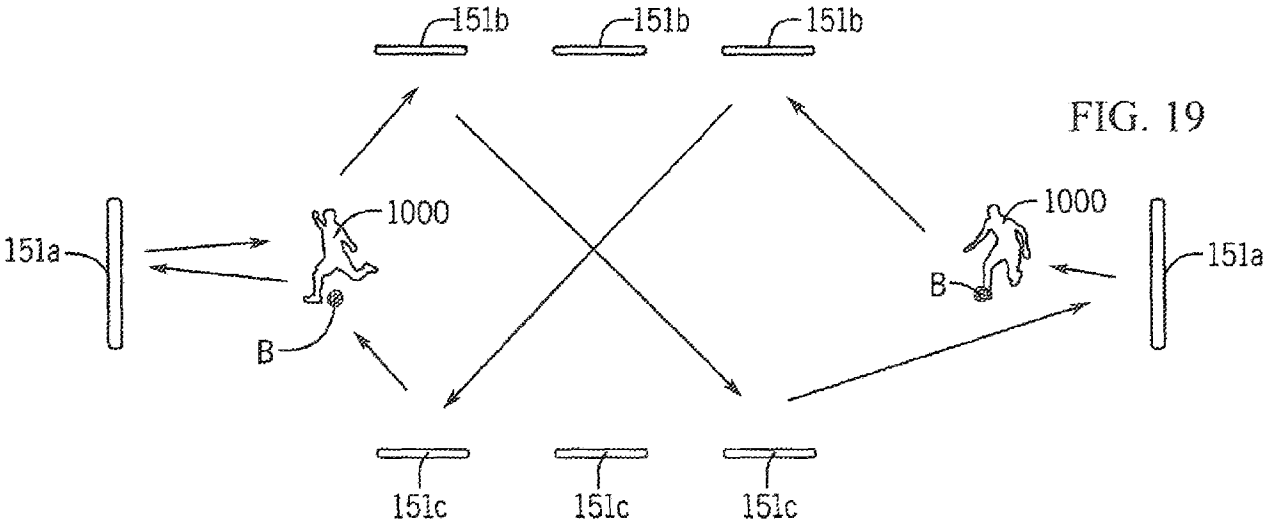
FIG. 19 is a schematic view of a method of using the modules of FIGS. 10 and 13.

Looking now at FIG. 19, a schematic view of the method of use of the module 250 of FIGS. 10-11, as well as module 459 of FIG. 13 is shown. In one embodiment of the method of using the modules 250, 459 the method, a player 1000 is positioned centrally within the walls and can perform these exercises:

1) player 1000 can pass the ball B against one of the passing walls on one side of the module, receive the ball B as it rebounds off of the wall while moving forward towards one of the shooting walls, and then pass the back at another passing wall on the same or opposite side of the module, or shoot the ball B at the adjacent shooting wall, and collect the ball from the shooting wall and reverse direction to repeat this process; or
2) players 1000 can pass the ball B against one or more of the passing walls, receive the ball B as it rebounds off of the wall, and then shoot the ball B at the shooting wall in playing a one on one or two on to game using the passing walls as additional "teammates" to move the ball B towards the desired shooting wall or "goal."

As the skill of the player(s) 1000 in controlling the ball B as it rebounds off of the walls increases, the player(s) 1000 can move to modules 250, 459 having progressively wider spaces between the passing and shooting walls, including being able to move certain portable walls present in the modules 250, 459, such that the passes and/or shots become more difficult to make and receive accurately, so that the player(s) 1000 can incorporate making realistic in-game moves, e.g., dribbling and juking or evading, prior to making and/or receiving the passes and shots against the walls of the modules 250, 459, and to incorporate more players 1000 within the games played within the modules 250, 459.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

What is claimed is:

1. A method for setting up a training course for improving the soccer skills of an individual; the method comprising the steps of:

a. selecting a training module comprising a first panel forming a first passing wall and a second panel forming a second passing wall, each of the first and second passing walls including a ball-rebounding surface, a support assembly connected to the first and second passing walls and resting on a ground surface on which the first and second passing walls is positioned and a ground-engaging member pivotally connected to the support assembly and movable between a use and a non-use position;

b. positioning the first and second passing walls on the ground surface in alignment with one another with a specified distance between the first and second passing walls, and engaging the ground-engaging member to the ground surface.

2. The method of claim 1 further comprising the steps of:

a. selecting at least one panel forming a shooting wall, the at least one panel including a ball-rebounding surface and a support assembly connected between the shooting wall and the ground surface; and b. positioning the shooting wall on the ground surface and spaced from the first and second passing walls.

3. The method of claim 2 wherein at least one of the first or second passing walls and the shooting wall are disposed parallel to one another.

4. The method of claim 1 wherein the specified distance between the first and second passing walls is between two (2) yards and (10) yards.

5. The method of claim 4 further comprising the steps of:

a. selecting first and second shooting walls; and b. positioning the first and second shooting walls on the ground surface a distance from the first and second passing walls.

6. The method of claim 5 wherein the step of spacing the first and second shooting walls from the first and second passing walls on the ground surface comprises positioning the first and second shooting walls on the surface generally perpendicular to the first and second passing walls.

7. The method of claim 1 wherein at least one of the first and second passing walls is moveable, and further comprising the step of moving one of the first and second passing walls after positioning the first and second passing walls in alignment with one another.

8. A method for setting up a training course for improving the soccer skills of an individual, the method comprising the steps of:

a. positioning a training module on a surface, the training, module comprising at least one panel forming a passing wall, the passing wall including a ball-rebounding surface and a support assembly connected between the passing wall and the surface on which the passing wall is positioned, wherein the assembly is secured to the at least one panel above a lower end of the panel and b. engaging the support assembly with the support surface, wherein the support assembly includes a pivoting engagement member, and the step of engaging the support assembly with the support surface comprises:

i. pivoting the engagement member from a non-use position to a use position; and ii. engaging the engagement member with the surface.

9. The method of claim 8 wherein the support assembly is movably secured to the at least one panel and further comprising the steps of:

a. moving the support assembly to a use position; and b. engaging the support assembly with a support the surface.

* * * * *